US005353711A

United States Patent [19]

Botticelli et al.

[11] Patent Number: 5,353,711

[45] Date of Patent: Oct. 11, 1994

[54] EXTENDED RANGE ARTILLERY PROJECTILE

[75] Inventors: Richard D. Botticelli, Beach Haven; Frank A. Brody, Rockaway; Francis Ottaviano, Denville, all of N.J.

[73] Assignee: The United States of America as represented by the Secretary of the Army, Washington, D.C.

[21] Appl. No.: 130,944

[22] Filed: Oct. 4, 1993

[51] Int. Cl.[5] ..... F42B 10/40

[52] U.S. Cl. ..... 102/490; 102/378; 102/379

[58] Field of Search ..... 102/490, 476, 473, 374, 102/376, 377, 378, 379, 380

[56] References Cited

U.S. PATENT DOCUMENTS

| | | | |
|---|---|---|---|
| 3,124,072 | 3/1964 | Herrmann | 102/374 |
| 3,540,679 | 11/1970 | McCullough et al. | 102/377 |
| 4,017,040 | 4/1977 | Dillinger et al. | 244/3.22 |
| 4,519,315 | 5/1985 | Arszman | 102/377 |
| 4,807,535 | 2/1989 | Schilling et al. | 102/490 |
| 4,846,071 | 7/1989 | Franzén et al. | 102/490 |
| 4,917,335 | 4/1990 | Tidman | 102/490 |
| 4,930,420 | 6/1990 | Meffert et al. | 102/490 |

*Primary Examiner*—David Brown

*Attorney, Agent, or Firm*—Anthony T. Lane; Edward Goldberg; Michael C. Sachs

[57] ABSTRACT

The disclosure is of an artillery projectile including a projectile body containing, among other things, a rocket motor at the front of the projectile and coupled to nozzles in the body of the projectile through which burning propellant gases flow.

2 Claims, 1 Drawing Sheet

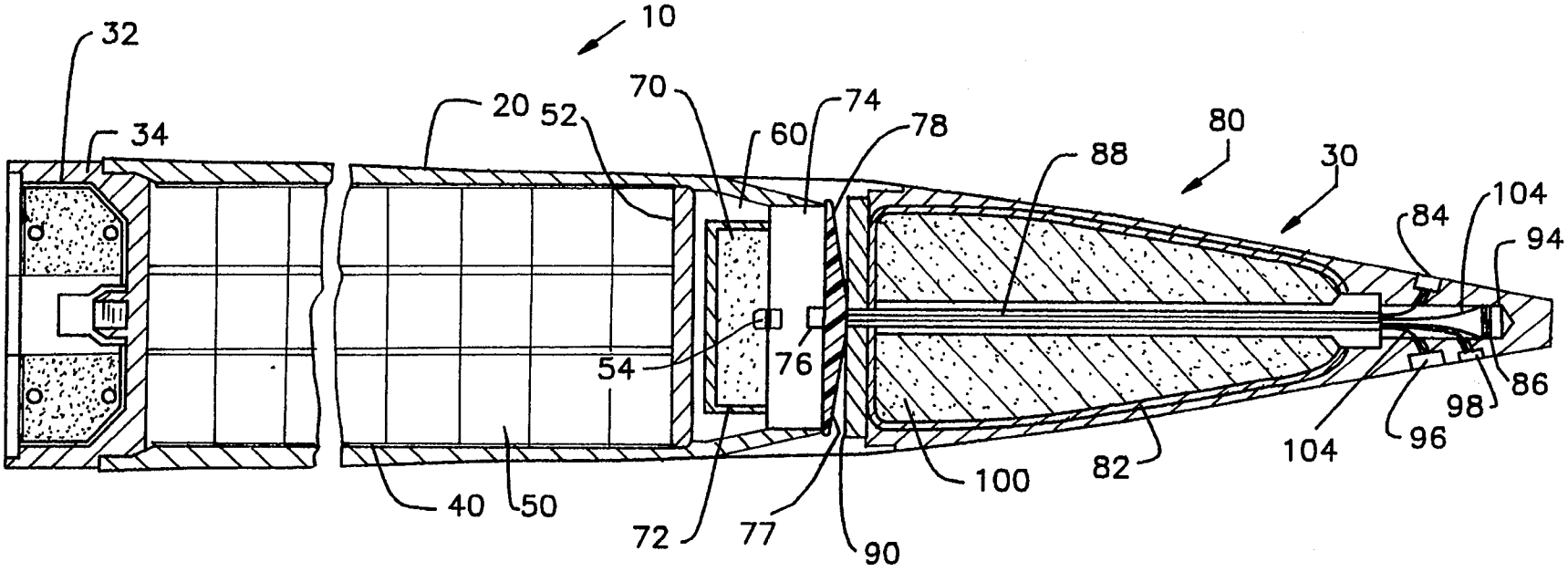
10
20
52
70
60
74
78
88
80
30
104
94
84
32
34
54
76
72
77
90
100
82
86
98
96
104
50
40

EXTENDED RANGE ARTILLERY PROJECTILE

The invention described herein may be manufactured, used and licensed by or for the Government for Governmental purposes without the payment to us of any royalties thereon.

BACKGROUND OF THE INVENTION

In the military, there is always a need to achieve extended range for artillery weapon systems without suffering a loss in payload and effectiveness of a weapon. Typically, increases in maximum artillery range capability have been accomplished by increasing muzzle velocity of the projectile through the use of larger cannon and cannon propelling charges, coupled with aerodynamic streamlining of the projectile and the incorporation of a post-launch, inflight propulsion system.

The use of larger cannon with larger cannon propelling charges to achieve significantly greater maximum range capability is limited by physical constraints of weight and size which adversely affect the mobility of the weapon.

Improvements in projectile design have similarly provided the means for increasing artillery maximum range capability. However, these improvements, individually, have inherent limitation. It is possible to simply incorporate a larger rocket motor at the expense of reduced payload/cargo in the projectile design configuration to achieve the desired maximum range goal. However, this would result in a degradation in lethality, hence effectiveness.

Base burning, an alternative technique for increasing maximum projectile range capability, cannot be improved to any great extent since range increases are the result of reducing projectile base drag, with no further range augmentation realized beyond that resulting from elimination of base drag.

SUMMARY OF THE INVENTION

The present invention solves the problems in the prior art to provide an extended range artillery projectile by means of a hybrid post-launch propulsion system consisting of a forward mounted rocket motor and an aft base burner in conjunction with an unique multifunctional fuzing means which provides delayed rocket motor ignition and initiation of the payload/cargo expulsion system at preselected times.

The invention uses electronic circuitry of high accuracy for a timing circuit which is preset either manually or remotely. The invention also uses a front-mounted unitary package of the rocket motor ignition delay/-payload expulsion system which provides greater efficiency in the utilization of available volume of the projectile ogive interior as compared to conventional means.

The invention achieves improvements over the prior art by (1) forward positioning the rocket motor , (2) incorporating both base burning and rocket assist in a single projectile and (3) using an integral multi-functional internally mounted fuzing means which employs a unitary timer to initiate rocket motor ignition and payload expulsion.

DESCRIPTION OF THE DRAWINGS

The drawing is a side sectional view of an artillery projectile embodying the invention.

DESCRIPTION OF THE INVENTION

An artillery weapon or projectile 10 embodying the invention includes a body 20 of conventional aerodynamic shape and including a front tapered end or nose 30. The body includes a compartment 32 at the rear end in which is mounted a base burner assembly 34 of generally conventional form and secured in place in any suitable manner. The base burner includes a solid fuel and is used to generate increased preessure in the projectile wake to reduce projectile base drag in the early part of the projectile's flight.

Forwardly of the rear compartment 32 is a larger compartment 40 in which a payload 50 is placed. The payload, at its front end, bears against a pusher plate 52 which is secured in place mounted transversely within the body 20 of the projectile.

Forwardly of the payload compartment is a smaller compartment 60 in which is mounted a container 72 which carries an but not expulsion charge 70, preferably but not necessarily, a solid propellant. The expulsion charge operates in conventional fashion to expel the payload from the projectile body. A timing module 74 for controlling the firing of the expulsion charge 70 and the rocket motor, to be described, is disposed adjacent to and forwardly of the expulsion charge container 72. The timing module is made up of conventional fuzing, safety, arming devices and initiators.

A slotted insulating plate 78 is disposed in contact with the leading surface 77 of the timing module and an initiator 76 is placed in the front surface 77 of the timing module 74. A second initiator 54 is positioned in operative relation with the expulsion charge 70.

According to the invention, a rocket motor 80 is provided at the forward end of the projectile 10. The rocket motor includes the timing module 74 and the plate 78 and a container 82 which lies within the front end of the projectile body 20 and contains a solid fuel or rocket grain 100.

The rocket motor fuel container 82 includes at its rear end a slotted rear plate 90 which communicates with a plurality of rearwardly extending nozzles (not shown) which extend through the wall of the projectile body to the outside atmosphere. The rocket motor's burning gases escape through the slotted rear plate 90 and nozzles and accelerate the projectile. A plurality of nozzles may be provided.

At the front end of the rocket motor container 82 is an electrical assembly for setting the timing module for firing the expulsion charge. This electrical assembly includes a timing control switch 84 having an associated display device, an inductive coil 86 mounted on a suitable support 94 along with other electrical devices 96 and 98 as required. Wires 104 from the various electrical components extend through a wiring conduit 88 which runs from the front end of the nose of the projectile through the fuel container 82 to the timing module 74 and the initiator 76.

The weapon 10 and its timing and firing mechanism, operate generally conventionally with the essence of the invention and its advantage being in the provision of the rocket motor at the front end of the weapon. A brief description of the operation of the weapon of the invention is as follows. The weapon or projectile is fired in a cannon such as a 155 mm artillery cannon in the same manner as conventional artillery projectiles. The hot gasses generated by the cannon propelling charge accelerate the projectile down-bore and provide the energetic stimulus to ignite the aft mounted projectile base burner assembly 34 while the projectile is in-bore. When the projectile leaves the muzzle, the base burner is depressurized due to the pressure differential between the exit plane of the cannon and the atmosphere, resulting in possible extinguishment of the base burner rocket propellant grain.

An igniter mechanism (not shown) housed within the base burner assembly, provides hot particles and gasses necessary to insure maintenance of ignition of the base burner propellant grain shortly after the projectile has emerged from the cannon. The base burner generates hot, fuel-rich gasses at a mass flow rate of sufficient magnitude, that upon exiting the base burner, they increase the pressure acting externally on the base of the projectile. This increase in the base pressure of the projectile results in a decrease in the projectile base drag, hence an increase in the maximum range of the projectile.

The base burner functions from projectile muzzle exit for a specified duration during the upward leg of the trajectory which is the highest drag regime during the projectile's trajectory. The time duration of base burning can be varied 0.60 to 2.5 mm per second at 1.0 atmospheres.

After the base burner has burned out, the projectile's forward rocket motor propellant 82 is ignited. A known type of initiation apparatus is provided in the timing module 74 including a battery (not shown) which is energized by the set back force exerted on the projectile during the firing process. When the battery is energized, it sets the timing module in operation for a period of time determined by the setting of the inductive coil 86 which acts as an electronic switch. After a period of time, the initiator 76 receives power from the system and it fires and causes ignition of the solid fuel 82.

Upon ignition, the burning rocket motor fuel generates hot gases which flow through the slotted plate 90 and out of the nozzles to impart thrust to the projectile for a finite period of time, for example 0.30 to 2.90 seconds, during which time the projectile is accelerated.

After rocket motor burnout, the projectile continues on a ballistic trajectory until payload/cargo expulsion. The expulsion of the payload/cargo 50 is similarly initiated by the pre-programmed electronically activated expulsion system. Electrical stimuli from the timing module are imparted to the initiator 54 which provides hot gasses and igniter particles to a gas generating propellant, which flows through the (slotted) pusher plate 52 and provides increased pressure in the expulsion charge container 72 of sufficient magnitude to expel the payload/cargo from the aft end of the projectile.

The payload descends to the pre-determined target where it functions in accordance with its mission. Different payloads may be utilized, dependent upon mission requirements.

What is claimed is:

1. An artillery projectile comprising:

a body in aerodynamic form and having a front end and a rear end, a payload in said body, a rocket motor assembly at the forward end of said body, and a multi-functional fuzing system having a first initiator for said rocket motor and a second initiator for said payload.

2. The projectile defined in claim 1 and including a base burner unit at said rear end of said body.

* * * * *